US005372014A

United States Patent [19]

Adams

[11] Patent Number: 5,372,014

[45] Date of Patent: Dec. 13, 1994

[54] MODULAR COOLING SYSTEM FOR MULTIPLE SPACES AND DISPENSED BEVERAGES

[75] Inventor: Rodney W. Adams, Beach Park, Ill.

[73] Assignee: Perfection Equipment, Inc., Gurnee, Ill.

[21] Appl. No.: 14,506

[22] Filed: Feb. 8, 1993

[51] Int. Cl.[5] ..... F25D 15/00

[52] U.S. Cl. ..... 62/175; 62/119; 62/185; 62/333

[58] Field of Search ..... 62/185, 99, 119, 333, 62/393, 175

[56] References Cited

U.S. PATENT DOCUMENTS 4,502,294 3/1985 Grant ..... 62/119 X
4,519,216 5/1985 Felicetta ..... 62/185

FOREIGN PATENT DOCUMENTS 2194840 8/1986 United Kingdom ..... 62/119
2204670 4/1987 United Kingdom ..... F25D 17/02
2205638 6/1988 United Kingdom ..... F25D 17/02

*Primary Examiner*—William E. Wayner
*Attorney, Agent, or Firm*—Dressler, Goldsmith, Shore & Milnamow, Ltd.

[57] ABSTRACT

A cooling system which is modular and capable of maintaining a variety of pre-selected temperatures for a plurality of liquids being dispensed and/or a plurality of spaces being air conditioned. A single refrigerator unit has a chilled glycol distribution line connected thereto and through which the chilled glycol is pumped. One or more cooler modules are tapped into the glycol distribution line at points wherever desired. The modules contain a low boiling refrigerant, a fluid tube carrying a relatively warm fluid (liquid or air), a cooling tube connected to the distribution line run and a flow control valve responsive to pressure changes in the module for permitting flow of chilled glycol thereinto and being adjustable to achieve the desired temperature of the fluid within the fluid tube.

18 Claims, 2 Drawing Sheets

MODULAR COOLING SYSTEM FOR MULTIPLE SPACES AND DISPENSED BEVERAGES

TECHNICAL FIELD

This invention relates to refrigeration or cooling systems for multiple spaces and/or dispensed beverages and, more particularly, to a cooling system having modular devices for maintaining variable temperatures at a plurality of beverage dispensing stations or spaces.

BACKGROUND OF THE INVENTION

Refrigeration requirements in both commercial and residential buildings frequently necessitate the maintenance of different temperatures at different locations in the building. Frequently, such needs were met by having a separate insulated enclosure and refrigeration unit, including compressor, condenser and evaporator, at each location. For example, a commercial establishment might have a wide variety of refrigeration needs, such as, chilling stored or prepared food, chilling bottled beverages at one or more temperatures, chilling keg-stored beverages, room air conditioning, etc. The use of individual refrigeration systems for each of the different tasks is obviously expensive and wasteful.

Wastefulness of the type described is further compounded by the fact that some condensers necessarily dump heat into areas or spaces that are cooled by other refrigeration equipment. For example, a refrigerator for food that is located in an air conditioned space is ejecting heat into that space. As a result, the air conditioning load is increased because the heat generated by the food refrigerator must be processed a second time.

It is well known that a single large compressor/condenser unit is more efficient than multiple small compressor/condenser units such as would be required in a system using multiple refrigerators. Accordingly, efforts have been made to achieve differing temperatures from a single compressor/condenser, but those efforts have been characterized by a number of disadvantages and limitations. Heretofore, the method employed to maintain different temperatures from a single compressor/condenser utilized a separate evaporator for each temperature requirement. Each of the evaporators was controlled by an expansion valve and all evaporators but the one required to be at the lowest temperature were equipped with a constant evaporator pressure control valve. The drawbacks of that type of system included the difficulty of balancing the individual evaporators, charging the entire system, and adjusting the multiple constant evaporator pressure control valves. In addition, that type of system required large quantities of refrigerant because of the extensive piping requirements.

There was disclosed in U.S. Pat. No. 4,949,552 a cooling system for maintaining desired drinking temperature of a beverage dispensed at locations remote from the place of beverage storage. That system efficiently utilized a single compressor/condenser unit to chill a minimal supply of glycol-water and the glycol unit coolant was flowed through tubing in contact with the beverage tubing in the line run. The patented system maintained the beverage at all dispensing stations within a narrow desired temperature range, or at substantially uniform temperature.

Peculiar problems of temperature maintenance apply to the dispensing of beer because different brewers insist that their beer tastes best and, therefore, must be served at certain optimum temperatures. For example, British brewers suggest that their beers and ales be drunk at temperatures between 52° and 55° F. Most German brewers insist that their beers be drunk at between 45° and 48° F. American and Australian beers, by contrast are recommended to be drunk at below 40° F. An establishment serving many brew varieties would be confronted with the problem of maintaining the different serving temperatures as indicated.

There thus exists a need for a cooling system which operates efficiently from a single, or perhaps two, compressor/condenser units, but has means for selectively maintaining different temperatures within wide desired ranges. Similarly, a need exists for a system capable of removing heat from one or several spaces in an efficient and cost effective manner.

SUMMARY OF THE INVENTION

The present invention provides a cooling system operable from a single compressor/condenser unit but having modular means for maintaining a variety of desired temperatures for a plurality of beverages or at a plurality of different locations. The system is highly flexible in that individual temperature control modules may be added or subtracted as required. The system uses minimal amounts of refrigerants and chilling agents and thus is most efficient as well as being environment friendly.

Briefly, the invention comprises a coolant, or glycol, chiller/circulator system incorporating a standard and available refrigeration unit with self-contained compressor/condenser/evaporator. The glycol chiller/circulator system is effective to chill the glycol-water mixture to a temperature well below the lowest temperature required at any place within the area or structure being serviced. The chilled glycol is pumped along a distribution line run consisting of two plastic tubes insulated from each other and also against heat lost from ambient. A pressure regulating valve constantly maintains a higher pressure in the outgoing or feed line from the chiller, than is present in the return line to the chiller. Thus, at any point along the distribution line run, access may be had to create a flow of the glycol chiller from the feed line and back to the return line.

A cooler module is connectable to the distribution line run at any desired point by means of a tee junction. The module is filled with a liquid refrigerant and has a glycol tube running through it in direct contact with the refrigerant. The glycol tube carries chilled glycol from the distribution line run feed line, through the module and back to the return line. A flow control valve is located in the glycol line at the inlet to the module and is operated by changes in pressure of the liquid refrigerant within the module.

A second, or fluid-carrying tube is also positioned in the module and this tube comprises a portion of a beverage line run and thus carries the beverage being dispensed into contact with the liquid refrigerant. Contact of the refrigerant with the warm beverage and cold glycol tube causes a typical cooling cycle of boiling, increased gas pressure, condensation of gas back to liquid and reduction of pressure to first open and then close the flow control valve.

In applications of the invention for air conditioning a space, the module contains the glycol tube but does not have the second beverage tube. Instead, the module is provided with a conventional heat exchanger carrying warm air in contact with the liquid refrigerant and a blower is provided for distributing the cooled air throughout the area being air conditioned.

Any number of modules may be connected into the glycol distribution line run or removed therefrom as desired, such connection or disconnection being simple to make and requiring no special plumbing expertise or tools. The temperature set for each module may be accurately maintained and such control is achieved by purely mechanical operation without the need for any electrical device.

Numerous other advantages and features of the present invention will become apparent from the following detailed description of the invention, from the claims, and from the accompanying drawings.

BRIEF DESCRIPTION OF THE DRAWINGS

In the accompanying drawings forming a part of the specification, and in which like numerals are employed to designate like parts throughout.

DETAILED DESCRIPTION OF THE INVENTION

Figure 1:
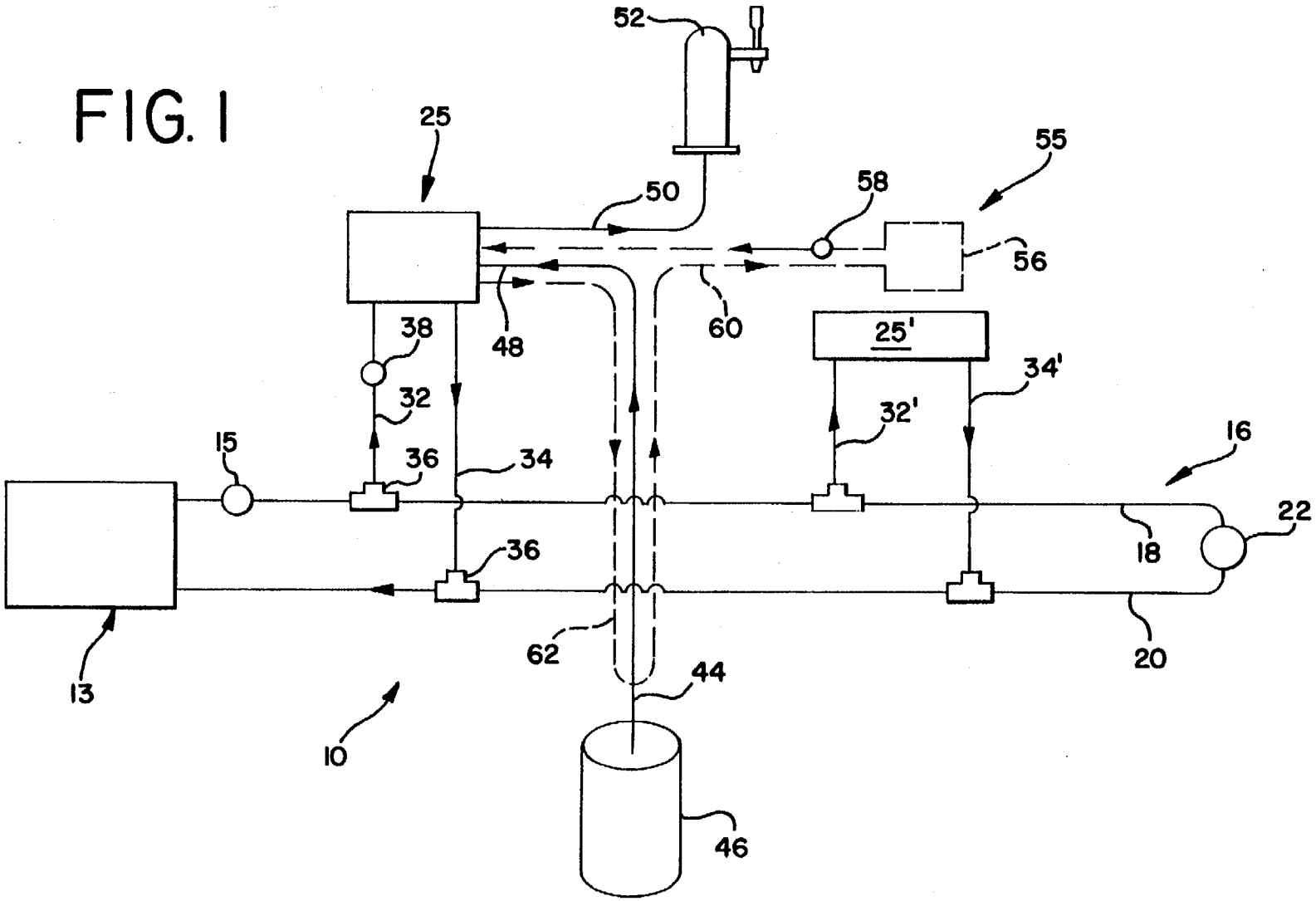
FIG. 1 is a schematic circuit diagram of a cooling system embodying the principles of the invention and showing the same applied for maintaining the temperature of dispensed beverages.

Referring more particularly to FIG. 1 of the drawings, the reference numeral 10 indicates generally a cooling system embodying the principles of the invention and illustrated as applied for the cooling of a beverage or beverages to be dispensed. Cooling system 10 comprises a coolant system, or glycol chiller/circulator unit indicated generally at 13. The glycol chiller/circulator is a self-contained unit having its own compressor/condenser/evaporator and may comprise any standard unit of the types that are commercially available. Preferably, the glycol chiller/circulator 13 comprises a unit like that shown in U.S. Pat. No. 4,949,552 which employs a minimal amount of glycol coolant and operates efficiently on the hot gas control principle there described.

Chilled glycol from the chiller/circulator 13 is pumped therefrom by a suitable pump 15 and flows through a distribution line run 16 comprising a feed line 18 and a return line 20. A pressure regulating valve 22 is installed in the line 16 at the end thereof and said valve maintains a constant pressure which is higher in the feed line 18 than in the return line 20.

Figure 3:
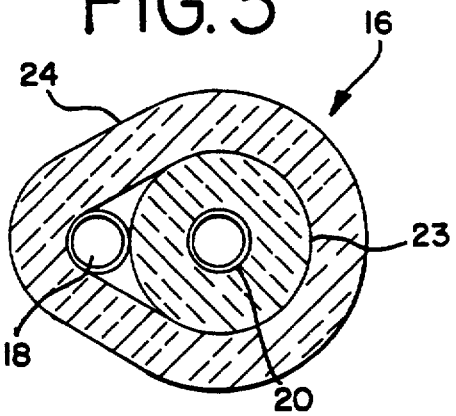
FIG. 3 is an enlarged sectional view of the glycol distribution line run.

Referring to FIG. 3, the feed and return lines of the line run 16 are shown encased in inner and outer insulators 23 and 24, respectively. It will thus be appreciated that the feed and return lines 18 and 20 are insulated from each other and from the ambient environment. The lines 18 and 20 preferably are made of suitable plastics so that the entire line run 16 is flexible and may be conveniently positioned wherever desired while occupying a minimum of space.

Figure 2:
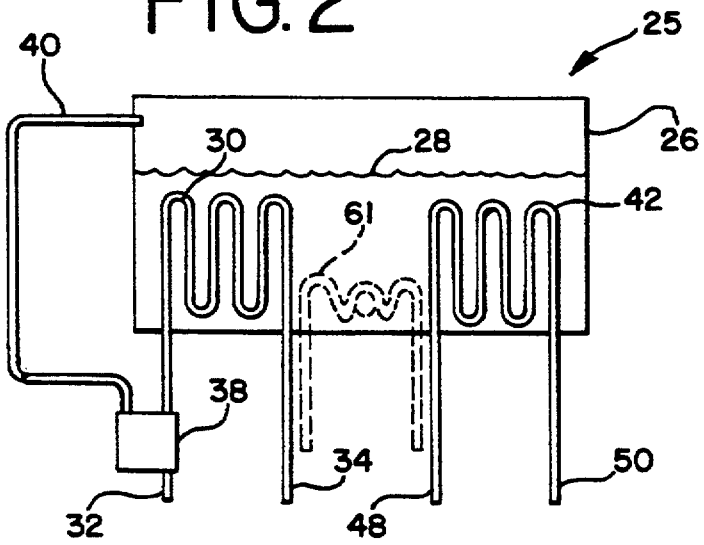
FIG. 2 is a sectional schematic view of the module of FIG. 1.

A cooler module indicated generally at 25 is operationally connected to the distribution line run 16, said module comprising a container 26 filled with a liquid refrigerant 28 (see FIG. 2). A glycol cooling tube 30 is mounted in the container 26 and in direct contact with the refrigerant 28. the cooling tube 30 comprises an inlet end 32 and an outlet end 34 connected respectively to distribution feed line 18 and return line 20 by tee junctions 36,36.

Flow of chilled glycol into the tube 30 is controlled by a pressure flow control valve 38 installed in the inlet end 32. Valve 38 comprises a pressure sensing tube 40 which communicates with the interior of the module container 26 near the top of the container.

A beverage tube 42 is also mounted in the container 26 in direct contact with the liquid refrigerant 28. The beverage tube 42 is typically made of stainless steel and comprises a section of the beverage line run 44 connected to a beverage storage container such as a beer keg 46 which may be stored in a remote room or cellar. The beverage tube 42 thus comprises an input tube 48 and an output tube 50 which runs to a beer dispenser 52.

Operation of the module 25 for dispensing the beer at the desired temperature may now be appreciated. Warm beer from storage entering the container 26 in the beverage tube 42 causes the liquid refrigerant to boil and gasify. Increased gas pressure causes the flow control valve 38 to open whereupon chilled glycol flows into the container 26 in the cooling tube 30. The refrigerant gas contacts the cold tube 30 and condenses back to liquid to cool the container interior and its contents, thereby reducing the pressure in the container. When the pre-set desired temperature of the beer is achieved, the valve 38 closes to stop flow of chilled glycol into the container, that temperature being controllable by the adjustable setting of the control valve.

Refrigerant 28 may comprise any conventional fluid like freon, but preferably will be a more environment friendly refrigerant like R-134A. Adjustable pressure operated flow control valves operable as described are also well known and commercially available.

As an optional feature, the invention may include an auxiliary beverage cooling circuit 55. Auxiliary circuit 55 comprises a small glycol reservoir tank 56, a pump 58 and an auxiliary line run 60. The auxiliary line run 60 includes a tube section 61 which is also mounted in the module container 26 in direct contact with the liquid refrigerant. The auxiliary line run 60 continues as at 62 to flow in contact with the beverage line run 44 and then returns to the reservoir 56 to complete the circuit. The auxiliary circuit 55 functions to maintain the beer in the beverage line run at somewhat below the keg storage temperature, thereby further increasing the efficiency of the system 10.

FIG. 1 illustrates fragmentarily a connection into the line run 16 of a second module 25' by means of the inlet end 32' and outlet end 34' of a cooling tube (not shown). It will be appreciated that a plurality of such cooling modules may be connected into the cooling system 10, or disconnected therefrom, as conditions of use require.

While container 26 has been schematically illustrated as being rectangular in configuration, the same could also comprise a copper tube or the like of enlarged diameter. In such an arrangement, a copper cooler tube 30 and stainless steel beverage tube 42 could be sealed within the larger diameter copper tube container 26. Where the auxiliary circuit 55 is incorporated into the system, the line run 60 may also comprise a third copper tube sealed within the copper tube container 26.

Figure 4:
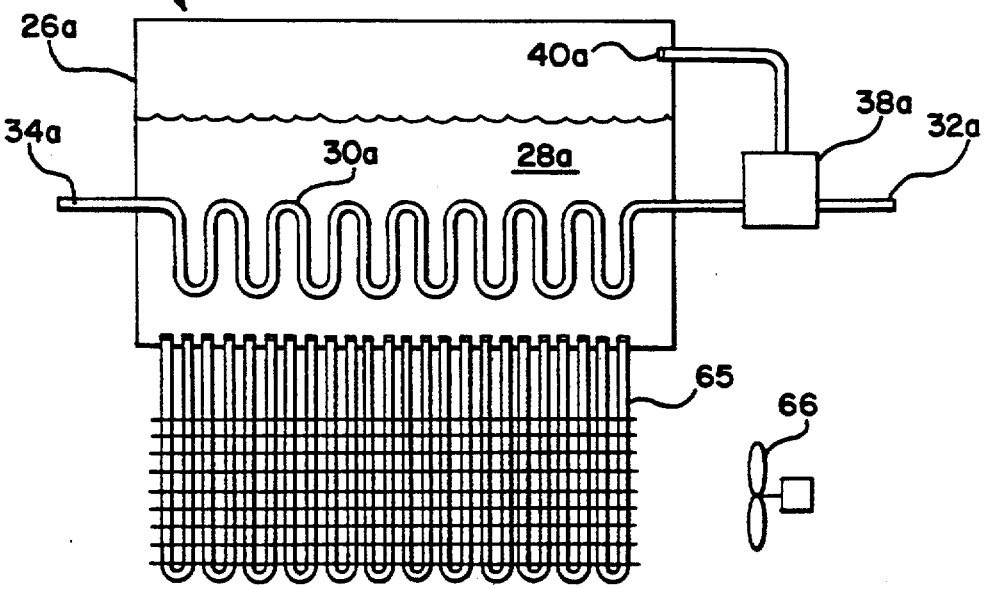
FIG. 4 is a sectional schematic view of a module for use in air conditioning a space.

Referring now to FIG. 4, application of the cooling system 10 for air conditioning a space will be described. In this arrangement, the module **25*a* comprises a container 26a filled with a liquid refrigerant 28a. A glycol cooling tube 30a is mounted in the container 26a, said tube comprising an inlet end 32a and an outlet end 34a connected to the distribution line 16 as previously described. A pressure flow control valve 38a is installed in the inlet end 32a and has a pressure sensing tube 40a connected thereto. A fluid tube comprising a heat exchanger 65, which may be of conventional construction, is mounted from the container 26a and has portions thereof in direct contact with the liquid refrigerant. Blower 66 is provided for distributing air over the heat exchanger into the space being air conditioned. Operation of module 25a is as already described, with the only difference being that the warm air of the space comprises the fluid that is carried by the heat exchanger 65 to the container 26a** to cause boiling of the liquid refrigerant and actuation of the cooling cycle.

The present invention provides a cooling system of high efficiency and versatility. It will thus be appreciated that any number of modules 25 and 25a may be connected to the glycol distribution line or removed therefrom as conditions warrant. Such connections are simple to make and permit the maintenance of a wide variety of temperatures. In addition, the modules are relatively small and compact and thus may be positioned in limited spaces such as under a beverage serving bar.

It will be appreciated from the foregoing detailed description of the invention and the illustrative embodiments thereof that numerous variations and modifications may be effected without departing from the spirit and scope of the novel concepts of the principles of the invention. It should also be understood that the language employed herein is for purposes of description rather than limitation, and it is intended that the scope of the invention be defined by the appended claims.

What is claimed is:

1. A modular cooling system comprising: a coolant/chiller/circulator unit having a compressor and condenser and adapted to chill a coolant to a chilled temperature;

a distribution line run operatively connected to said unit and pump means for pumping the chilled coolant through said distribution line run and back to the unit;

a cooler module containing a low temperature boiling liquid refrigerant operatively associated with the coolant/chiller circulator unit;

a cooler tube mounted in said module in contact with the refrigerant, said cooler tube being connected to said distribution line run and adapted to carry chilled coolant into the module and back to the distribution line run;

a fluid tube mounted in said module in contact with the refrigerant for carrying a relatively warm fluid into the module to vaporize the refrigerant and initiate a cooling cycle in the module; and adjustable valve means associated with said cooler tube for maintaining a constant temperature of the liquid refrigerant in the module.

2. A modular cooling system according to claim 1 wherein said distribution line run comprises a feed line and a return line and a back pressure regulating valve in the distribution line run for maintaining a higher pressure in the feed line than in the return line.

3. A modular cooling system according to claim 2, wherein said fluid tube comprises an inlet end and an outlet end, said inlet end being connected to said feed line, said outlet end being connected to said return line.

4. A modular cooling system according to claim 3 wherein said adjustable valve means comprises a pressure operated flow control valve positioned in said fluid tube inlet end, said pressure operated flow control valve comprising a pressure tube communicating with the interior of the module, whereby changes in pressure within the module resulting from vaporization and condensation of the refrigerant controls flow of chilled coolant into the fluid tube.

5. A modular cooling system according to claim 1 wherein said coolant comprises a glycol-water mixture.

6. A modular cooling system according to claim 4 wherein said fluid tube comprises one end connected to a liquid storage source and an opposite end connected to a dispenser for the liquid.

7. A modular cooling system according to claim 6 wherein said liquid storage source comprises a beer keg positioned in an area remote from the cooler module and said fluid tube comprises a portion of the beer line run from the keg.

8. A modular cooling system according to claim 7 comprising an auxiliary line run in intimate contact with said beer line run and adapted to maintain the temperature of the beer in said beer line run below the temperature of the beer in the keg.

9. A modular cooling system according to claim 8 wherein said auxiliary line run comprises an auxiliary cooling tube mounted in said module in contact with the refrigerant, a glycol mixture reservoir and a pump for flowing the glycol mixture through said auxiliary line and back to the reservoir.

10. A modular cooling system according to claim 4 wherein said fluid tube comprises a portion of a heat exchanger for carrying relatively warm air into the module, other portions of said heat exchanger being external of the module and in contact with ambient air.

11. A cooling system for maintaining a plurality of beverages being dispensed at stations remote from the beverage storage area at a plurality of desired dispensing temperatures comprising:

a self-contained glycol/chiller/circulator unit having a compressor, condenser, chilled glycol distribution line run and a pump for flowing the chilled glycol through the distribution line run;

a plurality of cooler modules connected to said distribution line run, one module for each of said beverages being dispensed, each of said modules comprising a container with low temperature boiling liquid refrigerant contained therein;

a cooler tube mounted in the container and connected to the distribution line run for carrying the chilled glycol into contact with the refrigerant and back to the distribution line run;

a beverage tube mounted in the container and being a part of a beverage line run for carrying relatively warm beverage into contact with the refrigerant; and an adjustable pressure operated flow control valve installed in said cooler tube and responsive to changes of pressure caused by the boiling and condensation of the refrigerant to permit flow of the chilled glycol into the container for periods sufficient to maintain the temperature of the beverage at the adjusted temperature.

12. A cooling system according to claim 11 wherein said distribution line run comprises a feed line and a return line and a back pressure regulating valve between said feed line and return line for maintaining a higher pressure in the feed line.

13. A cooling system according to claim 12 wherein said cooler tube comprises an inlet end exterior of the container connected by a T-junction to the feed line and an outlet end exterior of the container connected by a T-junction to the return line.

14. A cooling system according to claim 13 wherein said flow control valve is mounted in the inlet end of said cooler tube, said flow control valve comprising a pressure tube communicating with the interior of the container and responsive to changes in gas pressure within the container and said flow control valve being adjustable to obtain a pre-set temperature of the beverage in the beverage tube.

15. A cooling system according to claim 11 comprising auxiliary cooling means operatively connected to said module and adapted to maintain the temperature in said beverage line run below the temperature of the stored beverage.

16. A cooling system according to claim 15 wherein said auxiliary cooling means comprises a glycol reservoir, a pump, an auxiliary cooling tube in said container connected to said reservoir, and an auxiliary line run connected to the opposite end of said auxiliary cooling tube lying in intimate contact with the beverage line run and returning to the reservoir.

17. A cooling system according to claim 16 wherein said container comprises an enlarged diameter copper tube and said cooler tube, beverage tube and auxiliary cooler tube lie sealed within said enlarged diameter copper tube.

18. A cooling system according to claim 17 wherein said cooler tube and auxiliary cooler tube comprise copper tubes and said beverage tube comprises a stainless steel tube.

* * * * *